US008272620B2

(12) United States Patent
Schwoerer

(10) Patent No.: US 8,272,620 B2
(45) Date of Patent: Sep. 25, 2012

(54) FORMWORK SYSTEM HAVING BOLT ELEMENT TIES ROTATABLY JOURNALED IN RESPECTIVE CAPTIVELY CONNECTED LOCKING ELEMENTS

(75) Inventor: Artur Schwoerer, Senden (DE)

(73) Assignee: PERI GmbH, Weissenhorn (DE)

( * ) Notice: Subject to any disclaimer, the term of this patent is extended or adjusted under 35 U.S.C. 154(b) by 865 days.

(21) Appl. No.: 10/585,018

(22) PCT Filed: Dec. 8, 2004

(86) PCT No.: PCT/EP2004/013981

§ 371 (c)(1),
(2), (4) Date: Mar. 29, 2007

(87) PCT Pub. No.: WO2005/066434

PCT Pub. Date: Jul. 21, 2005

(65) Prior Publication Data

US 2008/0023622 A1 Jan. 31, 2008

(30) Foreign Application Priority Data

Jan. 5, 2004 (DE) ..... 10 2004 001 091

(51) Int. Cl.
*E04G 17/065* (2006.01)

(52) U.S. Cl. ..... 249/40; 249/190

(58) Field of Classification Search ..... 249/42, 249/43, 40, 45, 190, 191, 213
See application file for complete search history.

(56) References Cited

U.S. PATENT DOCUMENTS

| | | | | |
|---|---|---|---|---|
| 913,583 | A | 2/1909 | Terwilliger | |
| 1,937,109 | A * | 11/1933 | Colt | 249/190 |
| 2,583,962 | A * | 1/1952 | Neptune | 249/40 |
| 2,584,822 | A | 2/1952 | Symons | |
| 2,620,542 | A * | 12/1952 | Fontaine | 249/40 |
| 2,859,503 | A * | 11/1958 | Hennig | 249/191 |
| 2,992,468 | A * | 7/1961 | Leonard | 249/40 |
| 3,167,842 | A | 2/1965 | Pauli | |
| 3,198,476 | A * | 8/1965 | Smith | 249/42 |
| 4,159,097 | A * | 6/1979 | Strickland | 249/40 |
| 6,935,607 | B2 * | 8/2005 | Ward et al. | 249/190 |
| 6,951,329 | B2 * | 10/2005 | Musk et al. | 249/190 |
| 7,152,843 | B2 * | 12/2006 | Ward et al. | 249/216 |
| 7,568,676 | B2 * | 8/2009 | Takagi et al. | 249/191 |
| 2004/0079860 | A1 * | 4/2004 | Ward et al. | 249/33 |
| 2004/0129857 | A1 * | 7/2004 | Musk et al. | 249/43 |

FOREIGN PATENT DOCUMENTS

| | | | |
|---|---|---|---|
| AP | 100 | A | 10/1990 |
| DE | 2408558 | A1 | 8/1975 |
| DE | 19754366 | A1 | 6/1999 |
| DE | 10336414 | A1 | 3/2005 |
| GB | 2057042 | A | 3/1981 |

* cited by examiner

*Primary Examiner* — Michael Safavi

(74) *Attorney, Agent, or Firm* — Kilpatrick Townsend & Stockton LLP

(57) ABSTRACT

The invention relates to a formwork system which comprises formwork elements having opposite formwork interior surfaces, which can be interlinked at a distance to one another by means of formwork ties. Said formwork ties are constituted of a bolt element and two locking elements that are configured so as to be coupled to the bolt elements in the two distal areas thereof facing away from each other and that are adapted to transmit tensile forces from the formwork elements onto the bolt element. The formwork system is characterized in that the locking elements comprise coupling elements for transmitting pressure forces from the formwork elements onto the bolt element.

19 Claims, 4 Drawing Sheets

FORMWORK SYSTEM HAVING BOLT ELEMENT TIES ROTATABLY JOURNALED IN RESPECTIVE CAPTIVELY CONNECTED LOCKING ELEMENTS

CROSS-REFERENCE TO RELATED APPLICATIONS

This application is a National Stage of International Application No. PCT/EP2004/013981, filed Dec. 8, 2004, and which claims the benefit of DE 10 2004 001 091.9, filed Jan. 5, 2004. The disclosures of the above applications are incorporated herein by reference.

BACKGROUND OF THE INVENTION

The invention relates to a formwork system comprising formwork elements which have mutually oppositely disposed formwork inner surfaces and can be connected to one another spaced apart from one another by means of formwork ties, wherein a formwork tie consists of a bolt element and two locking elements which, in the two mutually remote end regions of the bolt element, can be coupled to it and are formed for the transmission of tensile forces from the formwork elements onto the bolt element.

The statements in this section merely provide background information related to the present disclosure and may not constitute prior art.

Formwork systems of this type are known in various embodiments from the prior art. They are used on construction sites of the most varied sizes in order, in the erection of reinforced concrete carcasses, to define volumes bounded by formwork areas or by an internal and an external formwork which are subsequently filled with liquid concrete. After the concrete has solidified, the formwork elements are then removed again, whereupon they can be reused as a rule for the assembly of further formworks.

Walls, columns, foundations, shafts and the like can be produced from concrete and reinforced concrete, for example, with the formwork systems.

With formwork systems, it is customary to couple the formwork elements forming the inner formwork to the formwork elements forming the outer formwork via formwork ties which are guided through tie holes present in the formwork elements and are connected to the formwork elements such that the internal formwork and the external formwork cannot move apart on the pouring in of concrete. To prevent such a movement, a formwork tie is formed by a bolt element and two locking elements, with the latter, as already mentioned, being suitable for the transmission of tensile forces from the formwork elements onto the bolt element.

The fact is disadvantageous with the known formwork systems that the previously used formwork ties are, as a rule, not able to prevent formwork elements of the internal formwork and of the external formwork from moving toward one another due to a corresponding force action, in particular on the pouring in of concrete, so that a wall ultimately to be produced does not have the desired thickness in all regions after completion.

SUMMARY OF THE INVENTION

An object of the invention consists of further developing a formwork system of the initially named kind such that it is reliably prevented that the internal formwork and the external formwork move toward one another, in particular on the pouring in of concrete.

The object is satisfied in accordance with the invention in that a formwork system of the initially named kind is made such that the locking elements of the formwork ties have coupling elements for the transmission of compressive forces from the formwork elements onto the bolt element.

Due to the provision of these coupling elements, the locking elements are not only suitable for the transmission of tensile forces, but also for the transfer of compressive forces from the formwork elements onto the bolt element. In this manner, the spacing set in a defined manner by the formwork ties in accordance with the invention between the mutually facing inner surfaces of the formwork of the internal formwork and of the external formwork is fixed in both directions so that this spacing can neither increase nor decrease on the filling with concrete or on the action of any other forces. It is thus ensured that the concrete walls to be erected have the desired thickness preset by the formwork ties in all regions.

The mutually oppositely disposed inner surfaces of the internal formwork and of the external formwork are preferably each formed by a group of individual formwork elements. In this connection, each group of formwork elements has tie holes, in particular circular tie holes, for the reception of the bolt elements of the formwork ties. These tie holes can be provided, for example, in the region of the connection sites of adjacent, mutually adjoining formwork elements so that each formwork element has semi-circular half-holes for ties, for example, in its marginal regions which, together with semi-circular tie holes of an adjacent formwork element, form complete tie holes.

The locking elements can each have a tensile force transmission surface cooperating with the respective outer side of the formwork elements. In this manner, a simple transmission of tensile force can be achieved from the formwork elements to the locking elements in that the locking elements are each positioned at the outer sides of the formwork elements such that their tensile force transmission surfaces contact the outer sides areally. In this case, the regions of the outer sides of the formwork elements surrounding the tie holes must then be made to cooperate with the tensile force transmission surfaces of the locking elements, which is in particular made possible by a sufficient stability of the regions.

It is particularly preferred for undercuts to be provided at the outer sides of the formwork elements which can be brought into active connection with compressive force transmission surfaces provided at the coupling elements of the locking elements. These undercuts can be provided, for example in a cost-favorable manner within the framework of an extrusion method, rolling or roller method, at section elements which are used as marginal regions of the formwork elements. In this case, the undercuts extend at least substantially over the total height of the formwork elements so that the active connection between the undercuts and the coupling elements generally becomes possible in the total marginal region of the formwork elements wherever tie holes are provided.

The coupling elements provided at the locking elements can be made in hook-shape in cross-section so that they can be hooked to the undercuts of the formwork elements. A particularly simple active connection between the coupling elements and the formwork elements can be established in a short time in this manner. Alternatively, with a somewhat worse embodiment, the locking element or the bolt element could also be screwed to the formwork element. In this case, the corresponding thread would then transmit both tensile forces and compressive forces from the formwork elements onto the bolt element. The thread present on the locking elements or on the bolt element would, in this case, then inter alia form the coupling element in accordance with the invention for the transmission of compressive forces from the formwork elements onto the bolt element.

The locking elements preferably have a substantially parallelepiped-shaped housing to which the coupling element is shaped. This parallelepiped-shaped housing, including the coupling element, can be manufactured, for example, by means of a extrusion method or a rolling or roller method as bulk material from which the individual housings can then be cut off in the desired length. The housings manufactured in the manner are then open at two mutually opposite sides in the cutting regions.

It is preferred for the one locking element to be captively (that is, non-releasably) connected to the bolt element, while the other locking element can be releasably connected to the bolt element. It is thereby achieved that the fitter only has to handle two parts per formwork tie, namely the bolt element captively connected to the one locking element and the other locking element. For the fitting, the locking element captively connected to the bolt element can be taken up and the bolt element inserted through the tie holes of the internal formwork and of the external formwork. Subsequently, the other locking element can be fastened at the end of the bolt element disposed opposite the locking element.

It is particularly advantageous for the bolt element to be rotatably journaled around its longitudinal axis in the locking element fixedly connected to it. In this connection, the bolt element can project out of the locking element fixedly connected to it or out of the housing on the side remote from the tensile force transmission surface. A contact surface for a tool is then preferably provided in this projecting region. This projecting region is in particular made as a square or hexagon so that it can be rotated around the longitudinal axis of the bolt element in a simple manner by means of a tool.

The bolt element can be provided with a thread at its end region remote from the locking element fixedly connected to it for the screwing into the locking element releasable from the bolt element. In this case, the bolt element can be taken up at its locking element fixedly connected to it and be pushed through the two tie holes of the internal formwork and of the external formwork, whereupon a screwing of the thread into the locking element releasable from the bolt element can be effected by a rotation of the tool contact surface around the longitudinal axis of the bolt element by hand or by means of a tool.

The bolt element is preferably conical, with the cross-section of the bolt element in particular reducing as the spacing from the locking element fixedly connected to it increases. It is thereby achieved that the bolt element can be pulled out of the tie holes or out of the solidified concrete without problem after the solidifying of the concrete.

It is advantageous for the locking element releasable from the bolt element to be provided with a thread sleeve into which the bolt element can be screwed, with the external diameter of the thread sleeve being dimensioned approximately in the same manner as the internal diameter of the tie holes formed in the formwork elements. The length of the section of the thread sleeve projecting out of the locking element is preferably dimensioned such that it extends at least over the total thickness of a formwork element cooperating with the locking element. In this manner, the thread sleeve can close the tie hole of a formwork element in the region of the formwork inner surface by the bolt element screwed into it in a manner such that no liquid concrete can enter into the tie holes and can thus exit the formwork. This sealing function of the thread sleeve is in particular relevant because the thread, as already mentioned, is provided at the thinner end region of the conically-shaped bolt element so that an intermediate space would exist here between the border of the tie hole and the bolt element without a thread sleeve. This intermediate space is, however, filled by the described thread sleeve.

The thread sleeve can be captively connected to the locking element associated with it, which keeps the number of parts to be handled small.

A locking block can in each case be held in the housings of the locking elements and be releasably connectable or fixedly connected to the bolt element. With a fixed connection between the locking block and the bolt element, the bolt element is preferably rotatably journaled in the locking block, but cannot be pulled out of the locking block. With a releasable connection between the bolt element and the locking block, the bolt element can be screwed either directly into the locking block or into a thread sleeve fixedly connected to it in the manner already explained.

The housings of the locking elements can be provided at mutually oppositely disposed sides with mutually aligned bolt holes through which the bolt element can be pushed. These bolt holes are necessary, on the one hand, to be able to couple the bolt element with the mentioned locking blocks located at the interior of the housing. On the other hand, the bolt holes are required to allow the tool contact surface of a bolt element to project out of the side of the housing remote from the formwork element.

It is particularly advantageous for the bolt holes each to have the shape of a curved elongate hole in which the bolt element and/or the thread sleeve are displaceable. Due to this displaceability, the housing can ultimately be moved relative to the bolt element or to the thread sleeve after the bolt element and the thread sleeve have been introduced into the tie holes of the formwork elements in order thus to effect a hooking of the coupling elements provided at the housing to undercuts of the formwork elements.

Further preferred embodiments of the invention are described herein.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DESCRIPTION OF THE PREFERRED EMBODIMENTS

Figure 1:
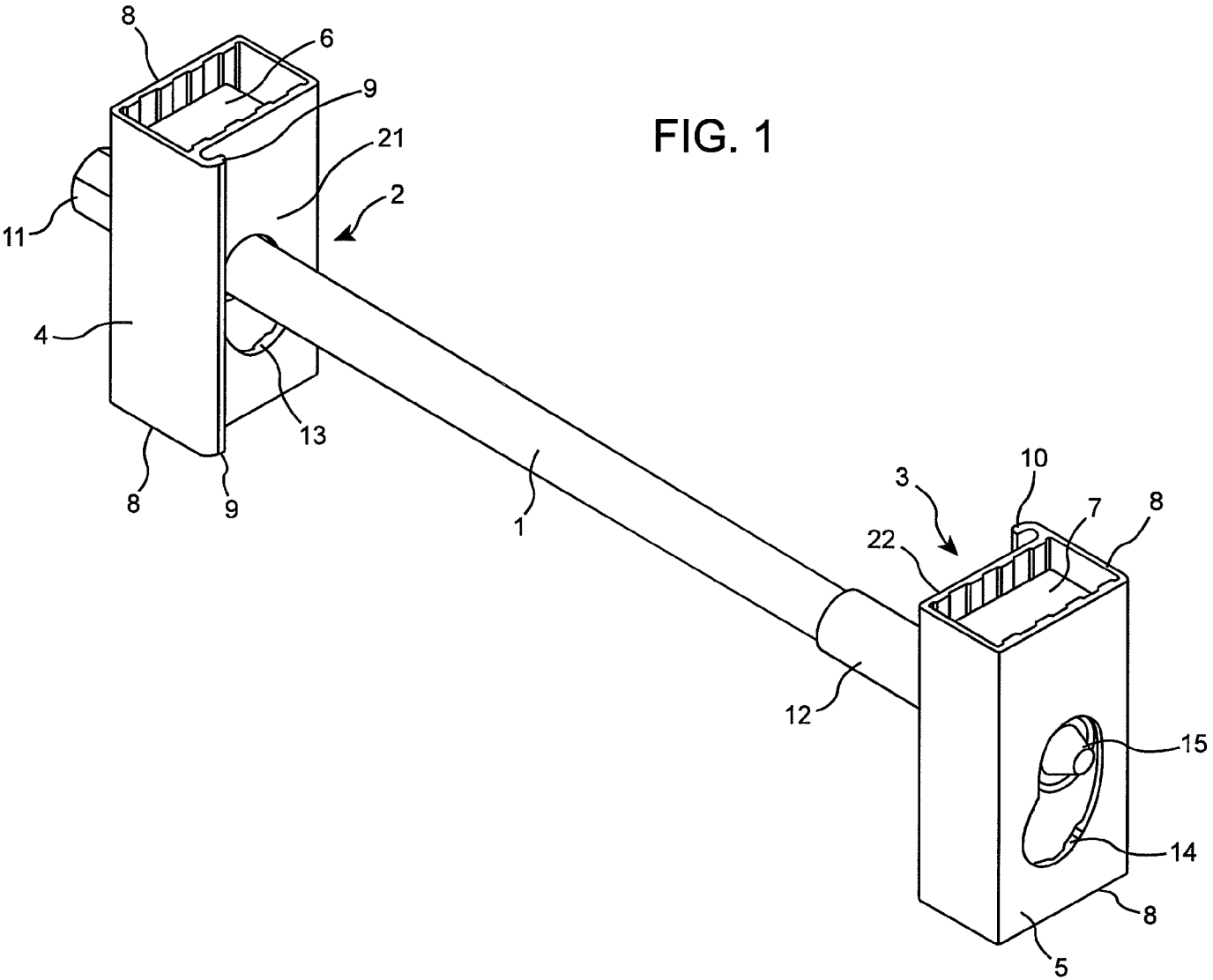
FIG. 1 is a three-dimensional view of a formwork tie in accordance with the invention.

The following description is merely exemplary in nature and is not intended to limit the present disclosure, application, or uses. It should be understood that throughout the drawings, corresponding reference numerals indicate like or corresponding parts and features.

FIG. 1 shows a tie bolt 1 which is coupled to one respective locking element 2, 3 each in its two end regions remote from one another.

Both locking elements 2, 3 each consist of a housing 4, 5, with one respective locking block 6, 7 being arranged in each housing 4, 5.

The housings 4, 5 are manufactured by means of an extrusion method or a rolling or roller method as bulk material from which they are cut off in the desired length along the cutting surfaces 8. This has the result that the housings 4, 5 are open at the end face in the region of the cutting surfaces 8 so that the locking blocks 6, 7 can be inserted into the housings 4, 5 through these open sides.

A coupling element 9, 10 is in each case shaped to the housings 4, 5 for the transmission of compressive forces from formwork elements onto the bolt element 1, with these coupling elements 9, 10 having a constant cross-section over the total length of the housings 4, 5 so that the coupling elements 9, 10 can be manufactured simultaneously with the housings 4, 5 by an extrusion method or rolling or roller method. The coupling elements 9, 10 are hook-shaped in cross-section such that they can be hooked with corresponding undercuts of the formwork elements (see FIG. 2). The orientation of the two coupling elements 9, 10 is selected such that they extend in hook shape in mutually opposite directions.

The bolt element 1 is produced from a solid material, in particular a metallic solid material, and has a conical shape which converges as the spacing from the locking element 2 increases. The bolt element 1 is furthermore held captively, but rotatably, in the locking block 6 of the blocking element 2, with it projecting out of the housing 4 in a direction remote from the locking element 3. This projecting region of the bolt element 1 is made as a hexagon 11 via which the bolt element 1 can be rotated around its longitudinal axis relative to the locking elements 2, 3 by hand or by means of a tool.

The locking block 7 received in the housing 5 is fixedly coupled to a thread sleeve 12 which projects out of the housing 5 in the direction of the locking element 2. The thread sleeve 12 is provided at the inside with a thread into which the end of the bolt element 1 remote from the locking element 2 can be screwed. Each of the two housings 4, 5 has one bolt hole 13, 14 each in mutually oppositely disposed housing sides which in each case has the shape of a curved elongate hole. The two bolt holes 13, 14 of each housing 4, 5 are aligned with one another. In FIG. 1, only one respective bolt hole 13, 14 per housing 4, 5 can be seen due to the perspective chosen.

The bolt element 1 extends on sides of the locking element 2 through both bolt holes 13, whereas with the locking element 3 the thread sleeve 12 extends through the bolt hole 14 facing the locking element 2 and not visible in FIG. 1. The other bolt hole 14 visible in FIG. 1 permits the passage of the bolt element end 15 if this has been screwed sufficiently into the thread sleeve 12.

The bolt holes 13, 14 are curved as elongate holes such that their respective upper regions are closer to the sides of the housings 4, 5 provided with the coupling elements 9, 10.

Figure 2:
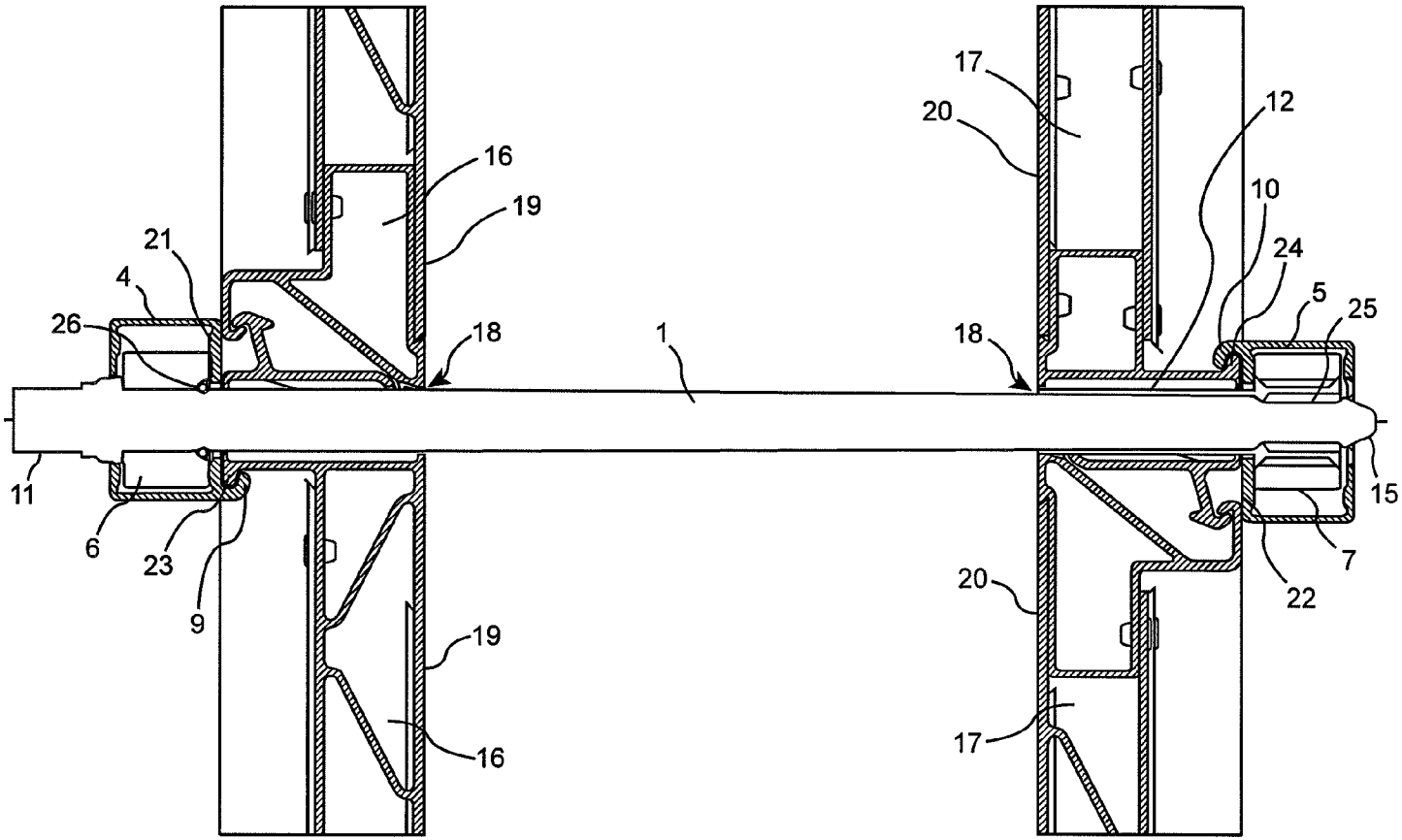
FIG. 2 is a cross-section through a formwork tie in accordance with FIG. 1, with the formwork tie being coupled to formwork elements of an internal formwork and of an external formwork.

FIG. 2 shows a section through a formwork tie in accordance with FIG. 1, with this formwork being connected to framework ties elements which each include an inner formwork and an outer formwork. The same reference numerals are used with respect to the formwork tie in FIG. 2 as in FIG. 1.

FIG. 2 accordingly shows two mutually coupled formwork elements 16 of an internal formwork as well as two mutually coupled formwork elements 17 of an external formwork.

In the region of the coupling sites of the formwork elements 16, 17, one respective tie hole 18 is provided in the internal formwork and in the external formwork and extends completely through the internal formwork and the external formwork and perpendicular to the inner formwork surfaces 19, 20 of the internal formwork and of the external formwork.

The internal formwork and external formwork each have a contact surface which extends in parallel to the formwork inner surface 19, 20 at their outside remote from the formwork inner surface 19, 20 and at which tensile force transmission surfaces 21, 22 of the housings 4, 5 are applied. The tensile force transmission surfaces 21, 22 (see FIG. 1) are located at the mutually facing sides of the housings 4, 5.

Furthermore, the formwork elements 16, 17 are each provided on their sides remote from the formwork inner surfaces 19, 20 with an undercut 23, 24 and the latter are engaged behind in each case by the hook-shaped coupling elements 9, 10 so that ultimately a hook connection results between the coupling elements 9 and 10 respectively and the undercuts 23 and 24 respectively. Those regions of the coupling elements 9, 10 in contact with the undercuts 23, 24 form the already mentioned compressive force transmission surfaces of the coupling elements 9, 10.

The bolt element 1 is fixed by means of a circlip 26 in the locking block 6 such that it is rotatable around a longitudinal axis, but cannot be released from the locking block 6.

Furthermore, the bolt element 1 has an external thread 25 at its end remote from the hexagon 11 and this external thread is screwed into a corresponding internal thread of the thread sleeve 12. The threaded sections of the external thread 25 and of the internal thread of the thread sleeve 12 extend only in the region of the housing 5; in the embodiment shown, they therefore do not extend up to and into that region which comes to lie inside the formwork elements 17. Alternatively, however, it would also be possible to arrange the internal thread of the thread sleeve 12 and the external thread 25 of the bolt element 1 such that they extend at least sectionally up to and into that region which ultimately comes to lie inside the formwork elements 17.

The length of the thread sleeve 12 is dimensioned such that it extends completely through the formwork elements 17 so that the tie hole 18 formed in the formwork elements 17 is closed in a sufficient manner and sealed by the thread sleeve 12 and the bolt element 1.

The arrangement shown in FIG. 2 shows that tensile forces can be transmitted from the formwork elements 16, 17 via the housings 4, 5 onto the bolt element 1 by the cooperation of the tensile force transmission surfaces 21, 22 with the outer sides of the formwork elements 16, 17. In the same way, compressive forces can be transmitted from the formwork elements 16, 17 via the housings 4, 5 onto the bolt element 1 since the coupling elements 9, 10 are hooked to the undercuts 23, 24 in the region of their compressive force transmission surfaces.

The manner in which a formwork tie in accordance with FIGS. 1 and 2 can be connected to a formwork in accordance with FIG. 2 will be described with reference to FIGS. 3*a-c* and FIGS. 4*a-c* explained in the following.

FIGS. 3*a*-4*f* each show a section through formwork elements 16, 17 in accordance with FIG. 2 as well as through the corresponding elements of the formwork tie, in each case including a plan view of the housings 4, 5 of the locking elements 2, 3 in the direction of the arrows A. Respective plan views of the housings 5 are shown in FIGS. 3*d*-3*f*; and respective plan views of the housings 4 are shown in FIGS. 4*a-c*.

Figure 3A:
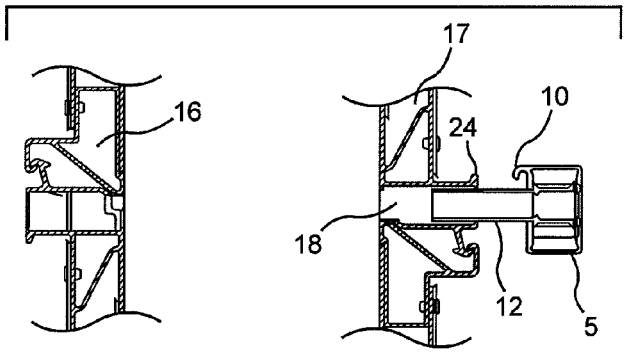
FIGS. 3A-C are sequential method steps in the coupling of a locking element provided with a thread sleeve with a formwork.
Figure 3D:
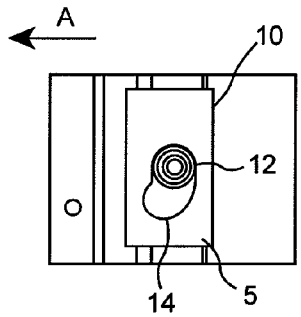
FIG. 3D is a horizontal view of FIG. 3A taken along arrow A.
Figure 3B:
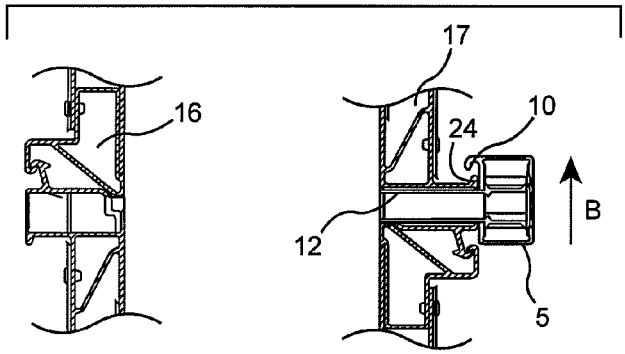
Figure 3E:
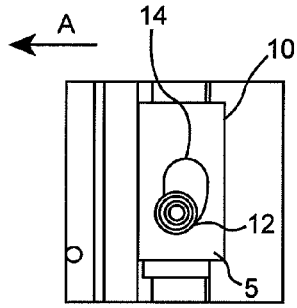
FIG. 3E is a horizontal view of FIG. 3B taken along arrow A.

In accordance with FIGS. 3*a* and 3*d*, the locking element 3 (FIG. 1) is taken up at its housing 5 and introduced with the thread sleeve 12 at the front into the tie hole 18 which is formed in the formwork elements 17. During this introduction, it is not important at which position the thread sleeve 12 displaceable in the bolt hole 14 is located in the bolt hole 14. The thread sleeve 12 can, for example, be located in the upper region of the bolt hole 14, as is shown in FIG. 3*d*.

If the thread sleeve 12 is now pushed so far into the tie hole 18 that the coupling element 10 would abut the undercut 24, the housing 5 must be raised relative to the thread sleeve 12 such that the thread sleeve 12 moves downwardly inside the bolt hole 14. It is achieved by this movement due to the curvature of the bolt hole 14 that the coupling element 10 moves in the direction of the arrow B in accordance with FIG. 3*b* so that it does not collide with the undercut 24 on the further insertion of the thread sleeve 12 into the tie hole 18. Accordingly, in the position of the thread sleeve 12 in the bolt hole 14, the coupling element 10 can be moved beyond the undercut 24, as can be seen from FIG. 3*b* and 3*e*. The thread sleeve 12 is completely inserted into the tie hole 18 in this position. However, in the position in accordance with FIG. 3*b* and 3*e*, a pulling of the thread sleeve 12 out of the tie hole 18 would still be possible, since the coupling element 10 and the undercut 24 are not yet hooked to one another.

Figure 3C:
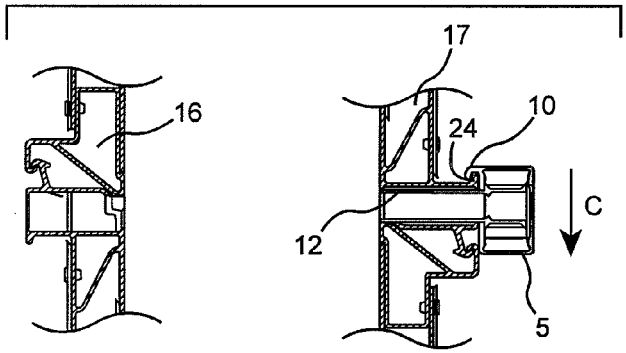
Figure 3F:
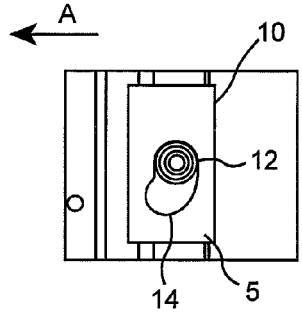
FIG. 3F is a horizontal view of FIG. 3C taken along arrow A.

Subsequently, in accordance with FIG. 3*c* and 3*f*, the housing 5 is then lowered again so that the thread sleeve 12 moves into its upper region in the bolt hole 14. A movement of the housing 5 in the direction of the arrow C drawn in FIG. 3*c* is thereby achieved, and indeed such that the coupling element 10 engages behind the undercut 24 such that the coupling element 10 and the undercut 24 are ultimately hooked to one another. It is achieved by this hook connection that the housing 5 can no longer be moved with the thread sleeve 12 against the direction of the arrow A out of the tie hole 18.

Figure 4A:
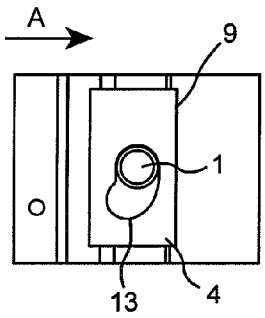
FIG. 4A is a horizontal view of FIG. 4D taken along arrow A.
Figure 4D:
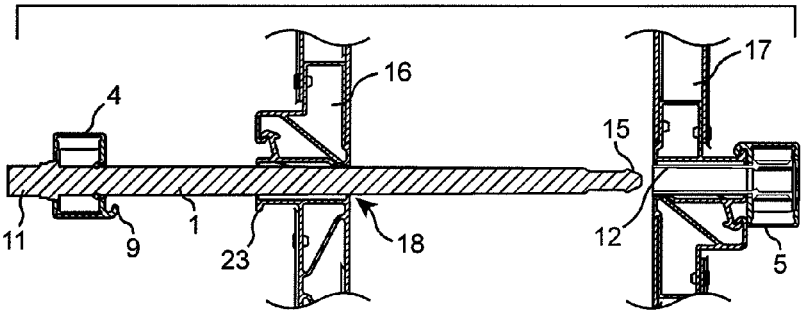
FIGS. 4D-F are sequential method steps in the coupling of a bolt element captively connected to a locking element with a formwork in accordance with FIG. 3*c*.
Figure 4B:
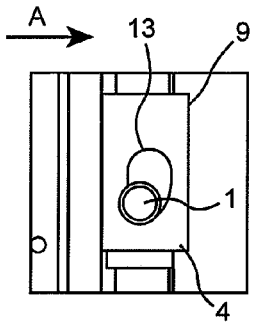
FIG. 4B is a horizontal view of FIG. 4E taken along arrow A.
Figure 4E:
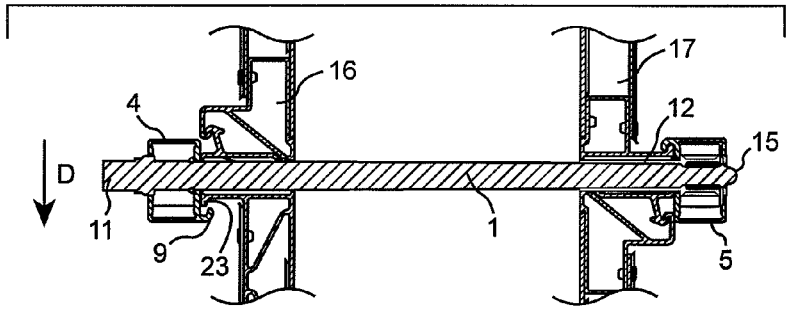

In accordance with FIGS. 4*a* and 4*d*, the bolt element 1 fixedly connected to the locking element 2 (FIG. 1) is now inserted through the tie hole 18 of the formwork elements 16, with it again (analogous to FIGS. 3*a* and 3*b*) not being important in this process at which position of the bolt hole 13 formed in the housing 4 the bolt element 11 is located. In the example in accordance with FIGS. 4*a* and 4*d*, the bolt element 1 is located in the region of the upper end of the bolt hole 13.

The bolt element 1 is now introduced so far into the tie hole 18 or screwed into the thread sleeve 12 until the coupling element 9 would collide with the undercut 23 of the formwork elements 16. Subsequently, in accordance with FIG. 4*e*, a raising of the housing 4 now takes place such that the bolt element 1 is moved into the lower region of the curved bolt hole 13, whereby (analogous to FIG. 3*e*) a movement of the housing 4 is achieved in the direction of the arrow D. In this position, the coupling element 9 can be moved beyond the undercut 23 by a continued screwing into the thread sleeve 12 until the bolt element 1 is completely screwed into the thread sleeve 12 via the hexagon 11.

After the complete screwing of the bolt element 1 into the thread sleeve 12, the housing 4 is then in turn moved downwardly so that the bolt element 1 is moved upwardly inside the bolt hole 13. A movement of the housing 4 in the direction of the arrow E in accordance with FIG. 4*f* is now thereby achieved such that the coupling element 9 engages behind the undercut 23. A hook connection therefore results between the coupling element 9 and the undercut 23 (analogous to FIG. 3*c*).

Figure 4C:
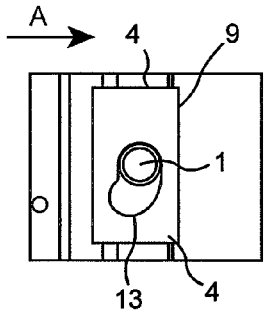
FIG. 4C is a horizontal view of FIG. 4F taken along arrow A.
Figure 4F:
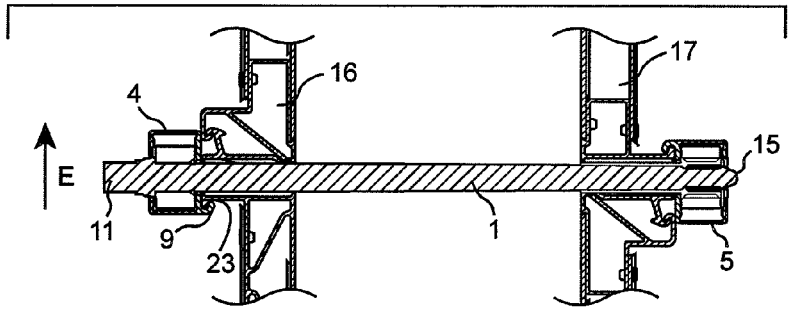

In the position shown in FIGS. 4*c* and 4*f*—which corresponds to the arrangement in accordance with FIG. 2—the formwork tie is finally connected to the formwork elements 16, 17 and is in a position to transmit tensile forces and compressive forces from the formwork elements 16, 17 via the housings 4, 5 onto the bolt element 1.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A formwork system, comprising:

formwork elements which have mutually oppositely disposed formwork inner surfaces; and formwork ties, wherein the formwork elements are connected to one another and spaced apart from one another by the formwork ties, wherein at least one of the formwork ties comprises a bolt element and two locking elements that are respectively coupled at two mutually remote end regions of the bolt element, wherein the locking elements abut the formwork elements to transmit tensile forces from the formwork elements onto the bolt element, and have coupling elements that are removably engaged with the formwork elements and structurally configured to transmit compressive forces from the formwork elements onto the bolt element, wherein one of the locking elements is captively connected to the bolt element and the other locking element is releasably connectable to the bolt element, wherein the bolt element is rotatably journaled around a longitudinal axis in the captively connected locking element.

2. A formwork system in accordance with claim 1, wherein the mutually oppositely disposed formwork inner surfaces are each formed by a group of individual formwork elements, with each group of formwork elements having tie holes for the reception of the bolt elements of the formwork ties.

3. A formwork system in accordance with claim 1, wherein the locking elements each have a tensile force transmission surface cooperating with the respective outer side of the formwork elements.

4. A formwork system in accordance with claim 2, wherein the region of the outer side of the formwork elements surrounding the tie holes is made to cooperate with the tensile force transmission surface.

5. A formwork system in accordance with claim 1, wherein undercuts are provided at outer sides of the formwork elements and can be brought into active connection with compressive force transmission surfaces provided at the coupling elements.

6. A formwork system in accordance with claim 5, wherein the coupling elements are hook-shape in cross-section so that they can be hooked with the undercuts of the formwork elements.

7. A formwork system in accordance with claim 1, wherein the locking elements each have a substantially parallelepiped-shaped housing, the housing being shaped to form the coupling element.

8. A formwork system in accordance with claim 7, wherein the parallelepiped-shaped housing, including the coupling element, is manufactured by means of an extrusion method or rolling or roller method, and is open at two oppositely disposed sides which extend perpendicular to the formwork surfaces.

9. A formwork system in accordance with claim 1, wherein the bolt element projects on a side remote from a tensile force transmission surface out of the locking element, the bolt element including a square or a hexagon contact surface for a tool.

10. A formwork system in accordance with claim 1, wherein the bolt element is provided at an end region remote from the captively connected locking element with a thread for screwing into the locking element releasable from the bolt element.

11. A formwork system in accordance with claim 1, wherein the bolt element is conical.

12. A formwork system in accordance with claim 11, wherein a thread is provided at the thinner end region of the conically formed bolt element.

13. A formwork system in accordance with claim 1, wherein the locking element releasable from the bolt element is provided with a thread sleeve into which the bolt element can be screwed, with the external diameter of the thread sleeve being dimensioned approximately like the internal diameter of the tie holes formed in the formwork elements.

14. A formwork system in accordance with claim 13, wherein a section of the thread sleeve projecting out of the locking element releasable from the bolt element is dimensioned to extend at least over the total thickness of the formwork element abutted to the locking element releasable from the bolt element.

15. A formwork system in accordance with claim 13, wherein the thread sleeve is captively connected to the locking element.

16. A formwork system in accordance with claim 7, wherein locking blocks are held in the housings and are releasably connectable or fixedly connected to the bolt element.

17. A formwork system in accordance with claim 16, wherein a first locking block is fixedly connected to a thread sleeve, whereas the bolt element is rotatably journaled around its longitudinal axis in a second locking block.

18. A formwork system in accordance with claim 1, wherein the two locking elements each include housings with mutually aligned bolt holes at mutually oppositely disposed sides.

19. A formwork system in accordance with claim 18, wherein the bolt holes each have the shape of a curved elongate hole in which the bolt element and/or a thread sleeve are displaceable.

* * * * *